United States Patent [19]

Hey et al.

[11] Patent Number: 4,892,202

[45] Date of Patent: Jan. 9, 1990

[54] DEEPWATER EXTENDED HOOK TRAVEL ATTACHMENT

[75] Inventors: John E. Hey, Eagan; Pierre C. Delago, Afton; James A. Carlson, St. Paul, all of Minn.

[73] Assignee: Amca International Corporation, St. Paul, Minn.

[21] Appl. No.: 187,615

[22] Filed: Apr. 28, 1988

[51] Int. Cl.[4] ..... B66C 23/52

[52] U.S. Cl. ..... 212/192; 212/232; 254/228; 254/254; 254/264

[58] Field of Search ..... 212/146, 190, 192, 232, 212/266; 114/258, 293; 254/228, 264, 254

[56] References Cited

U.S. PATENT DOCUMENTS

| | | | |
|---|---|---|---|
| 2,902,177 | 9/1959 | Stoddard et al. . | |
| 3,602,413 | 8/1971 | Reynard et al. . | |
| 3,711,000 | 1/1973 | Reynard et al. . | |
| 3,718,316 | 2/1973 | Larralde et al. . | |
| 3,999,610 | 12/1976 | Sage et al. . | |
| 4,168,053 | 9/1979 | Boenninghaus . | |
| 4,266,680 | 5/1981 | Velikoselsky et al. . | |
| 4,267,932 | 5/1981 | Vessey et al. . | |
| 4,271,970 | 6/1981 | Miller et al. | 212/192 |
| 4,273,067 | 6/1981 | Lloyd et al. | 212/190 |
| 4,446,807 | 5/1984 | Johnson | 114/293 |
| 4,448,393 | 5/1984 | Habegger et al. . | |
| 4,456,226 | 6/1984 | Stumpmeier . | |
| 4,552,339 | 11/1985 | Werners et al. . | |
| 4,593,884 | 6/1986 | Zschock et al. . | |
| 4,615,509 | 10/1986 | Biass . | |

*Primary Examiner*—Sherman D. Basinger
*Assistant Examiner*—Stephen P. Avila
*Attorney, Agent, or Firm*—Dorsey & Whitney

[57] ABSTRACT

An apparatus for increasing the available hook raising and lowering distance is attached to a crane or other lifting structure having a boom and at least one lifting tackle utilizing at least one lifting line connected to a prime mover. The apparatus utilizes a support means attached to the crane boom substantially at the connection point of an existing upper tackle. A fixed, lower gripper platform is suspended from the support means and has at least one linear winch grip mounted thereon. A movable, upper gripper platform is connected to at least one lifting line associated with the lifting tackle. The upper gripper platform has at least one linear winch grip mounted thereon. The upper gripper platform is also adapted to reciprocate between the lower gripper platform and the upper tackle in response to the prime mover drawing in or paying out the lifting line. At least one extended load line for attachment to a load passes through the linear winch grips on the lower and upper gripper platforms. Take up reels or other such means take up and let out the extended load line. A control means connected to the linear winch grips mounted on the upper and lower platforms causes these grips to individually and selectively release or grip the extended load line.

20 Claims, 5 Drawing Sheets

DEEPWATER EXTENDED HOOK TRAVEL ATTACHMENT

TECHNICAL FIELD

The present invention relates to lifting cranes, derricks and the like used for lifting and transporting loads. More particularly, the present invention relates to an attachment for a lifting crane, derrick, drilling derrick or the like allowing such a device to use its rated hook raising and lowering capacity in greater depths.

BACKGROUND ART

In most dry land situations, the primary limitations of a crane, derrick or other lifting device are its weight lifting capacity and the vertical and horizontal reach of its boom. Only rarely is it necessary for the crane to be able to draw in extended lengths of cable reaching far below the base of the crane.

Large cranes used in offshore drilling or other deepwater operations face a very different situation. They are frequently required to handle not only lifting tasks at the surface of the water or at the decks of the barge on which they are located, but also lifting tasks below the surface of the water. In particular, they may be required to carry out lifting tasks reaching all the way to the bottom of the body of water in which they are located. As exploration for oil and minerals has been extended to ever deeper areas of the oceans, the ability of a crane to utilize its full lifting capacity at great depths becomes important. In many applications, it is desirable for a crane having a rated capacity of 500 or more short tons to be able to utilize this capacity at depths of 2000 feet or more.

One proposed solution to the problem is the complete replacement of a crane type lifting device, which utilizes conventional rotary winches, with linear winch equipment. If this is done, the natural limitations of a rotary winch resulting from cable buildup on winch drums and the corresponding increase in moment arm and loss of drawing power as the cable moves further and further away from the axis at which power is applied, are avoided. Complete replacement of equipment is not only expensive, but linear winches are sometimes not well suited for lifting tasks that require the reach afforded by a boom.

Another way of increasing the deepwater capacity of a conventional crane is by re-reeving the available cable to reduce the number of parts of tackle. This makes greater hook travel length available without having to replace the existing cable with a longer cable, but it trades mechanical advantage for length. Moreover, the crane is still limited by the increase in moment arm at the rotary winch caused by cable buildup. Simply taking up and storing additional cable on drums of limited size can also be difficult. The length of a crane's hook travel can also be extended by the addition of slings on the end of the hook, but these require a great deal of special handling and increase the number of points at which mechanical failure or other problems can occur. Also, the addition of slings does not solve the loss of lifting power associated with cable buildup.

Accordingly, there is a need for apparatus that extends the depth at which a conventional crane can work, without significantly decreasing its lifting capacity.

SUMMARY OF THE INVENTION

In accordance with the present invention, an apparatus for increasing the available hook raising and lowering distance is attached to a crane or other lifting structure having a boom and at least one lifting tackle utilizing at least one lifting line connected to a prime mover. The apparatus utilizes a support means attached to the crane boom substantially at the connection point of an existing upper load tackle.

A fixed, lower gripper platform is suspended from the support means and has at least one linear winch grip mounted thereon. A movable, upper gripper platform is connected to at least one lifting line associated with the lifting tackle. The moveable gripper platform has at least one linear winch grip mounted thereon. The moveable gripper platform is also adapted to reciprocate between the fixed gripper platform and the upper tackle in response to the prime mover of the crane drawing in or paying out the lifting line. At least one extended load line for attachment to a load passes through the linear winch grips on the fixed and moveable gripper platforms. Take up reels or other such means take up and let out the extended load line. A control means connected to the linear winch grips mounted on the moveable and fixed platforms causes these grips to individually and selectively release or grip the extended load line. The invention also encompasses connection of the at least one linear winch grip associated with the fixed gripper platform at a fixed location on or near the boom, instead of suspended below the moveable gripper platform, to provide a fixed grip means above the moveable gripper platform.

A primary objective of the present invention is extending the below-boom lifting reach (or hook travel) of an existing heavy crane, while retaining the use of all hooks on that machine.

Another objective of the present invention is to provide an attachment that increases hook travel distances while using the existing lifting power of the crane to its full capacity.

A further objective of the present invention is to provide an adaptation to an existing crane that extends its below-boom reach to the full length of longer cables available on the international market without changing the existing rigging on the crane.

Another objective is to provide a rigging system that does not have lines moving at different speeds and in different directions relative to the load and any possible power or control leads attached to the load.

These and other objectives of the present invention will become apparent with reference to the drawings, the description of the preferred embodiment and the appended claims.

DESCRIPTION OF THE PREFERRED EMBODIMENT

Figure 1:
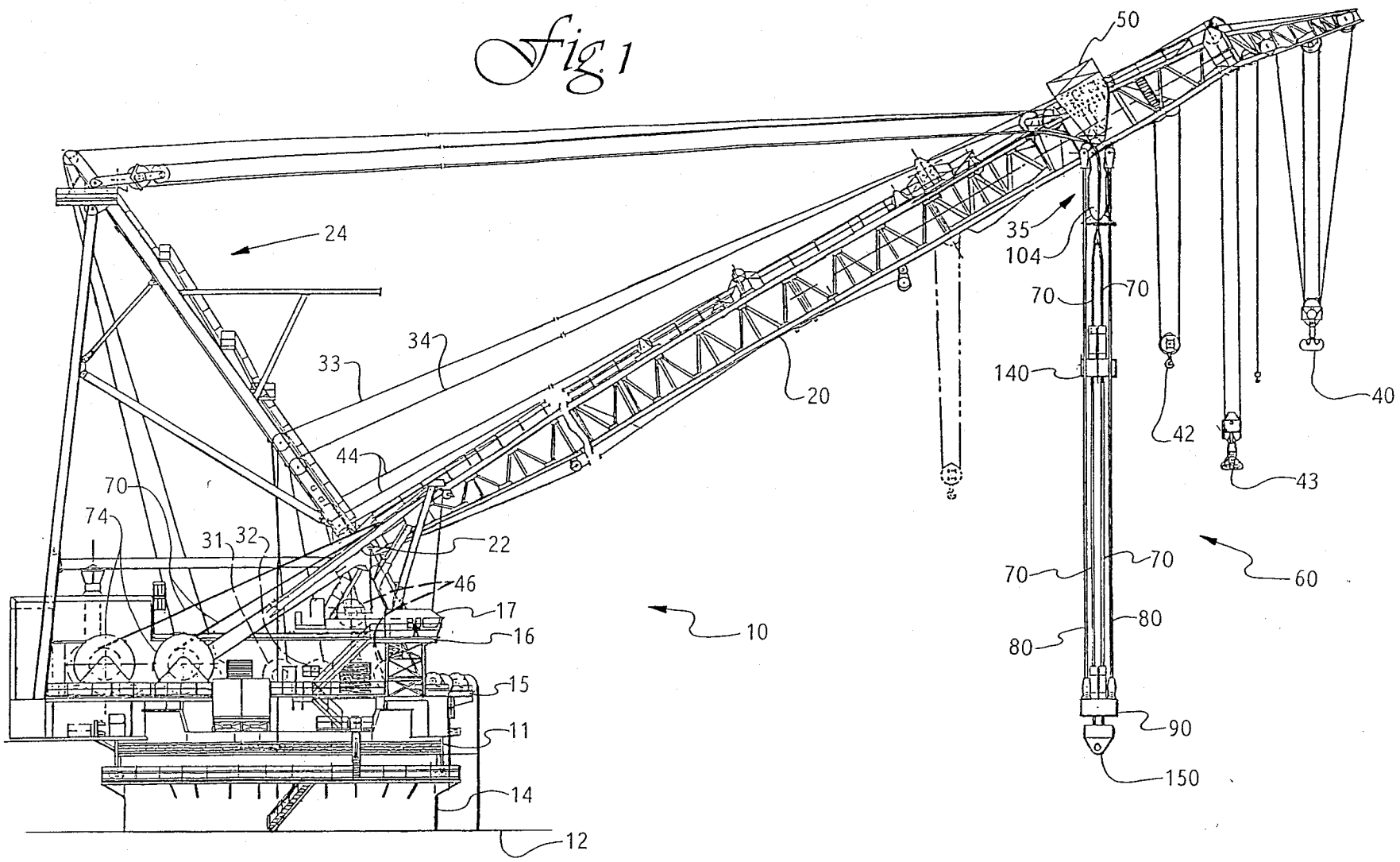
FIG. 1 is a right side elevational view showing the general arrangement of a deck-mounted heavy lift crane having the present invention attached thereto.

FIG. 1 shows a crane 10 mounted on the deck 12 of a barge, drilling platform, drilling vessel, or the like. This is a typical environment in which the invention can be used, although as will become clear, the invention is applicable to any winch powered lifting device having lines and tackle that permit the lines to be repeatedly drawn in and paid out.

FIG. 1 shows the general features of the crane 10 that form the environment in which the invention is used. The crane 10 rotates on a base comprised of a roller system 11 that moves on top of a tub 14. Above the roller system 11 is a first equipment deck 15 on which winches, drums and various other items of equipment to be explained in greater detail are mounted. Above the first equipment deck 15 is a second equipment deck 16 containing additional winches or drums and containing the control station 17 from which operations of the crane 10 are controlled. The crane boom 20 extends upward and outward at an angle from a boom hinge 22 that is supported on the lower portion of an A-frame 24.

The existing boom 20 of the crane 10 includes, at its outermost extent, a whip block 40 and two or more auxiliary blocks 42, 43 inward therefrom. Lines 44 for the whip block 40 and the auxiliary blocks 42, 43 extend along the top of the boom 20 and are connected to one or more winches or hoist drums 46 on the second equipment deck 16 and first equipment deck 15. Because these lines and drums and the associated blocks and hooks are not changed by the introduction of the invention, they will not be discussed further herein. But it should be noted that they continue to be operational despite introduction of the invention.

Figure 2:
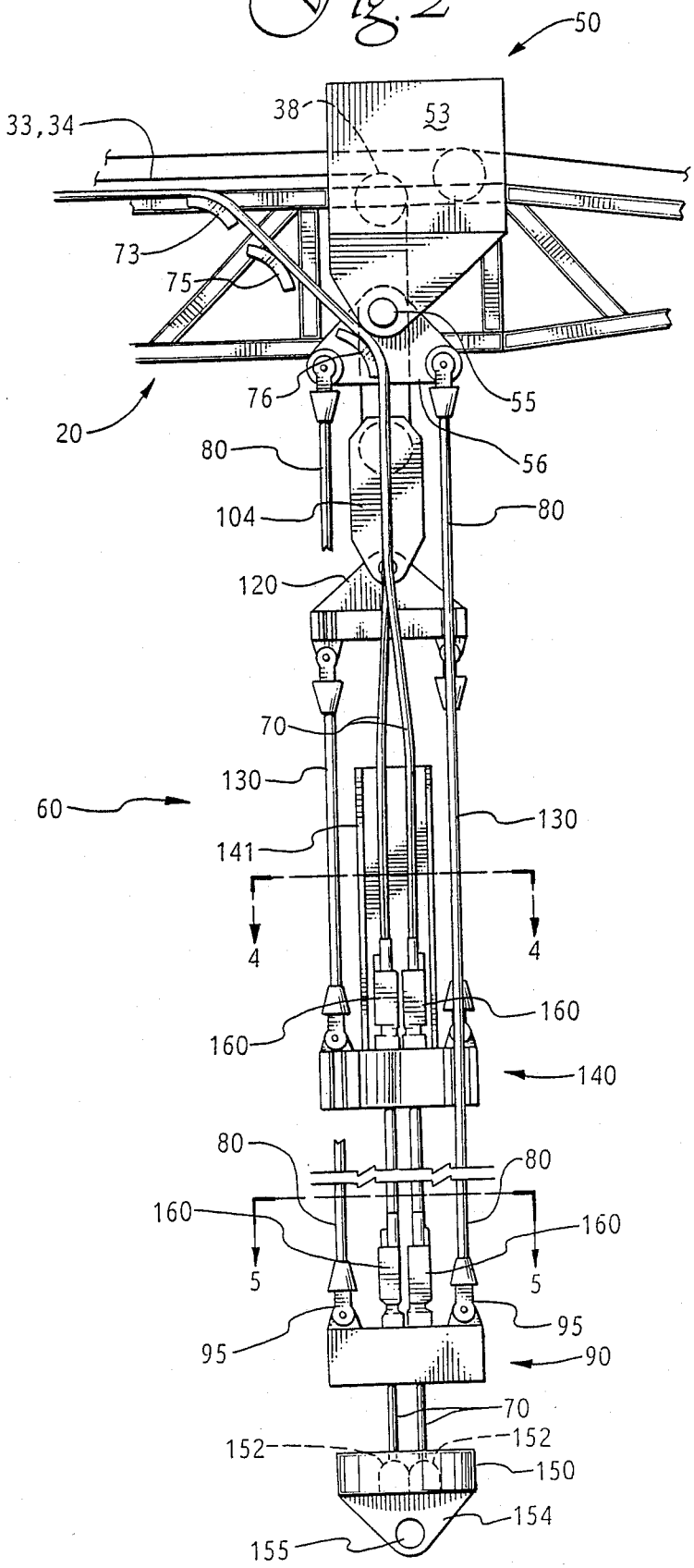
FIG. 2 is an enlarged detail of the load length of the preferred embodiment of the present invention from its junction with the crane boom to the lower yoke and cable attachment and with the pendants for the fixed lower platform foreshortened.
Figure 3:
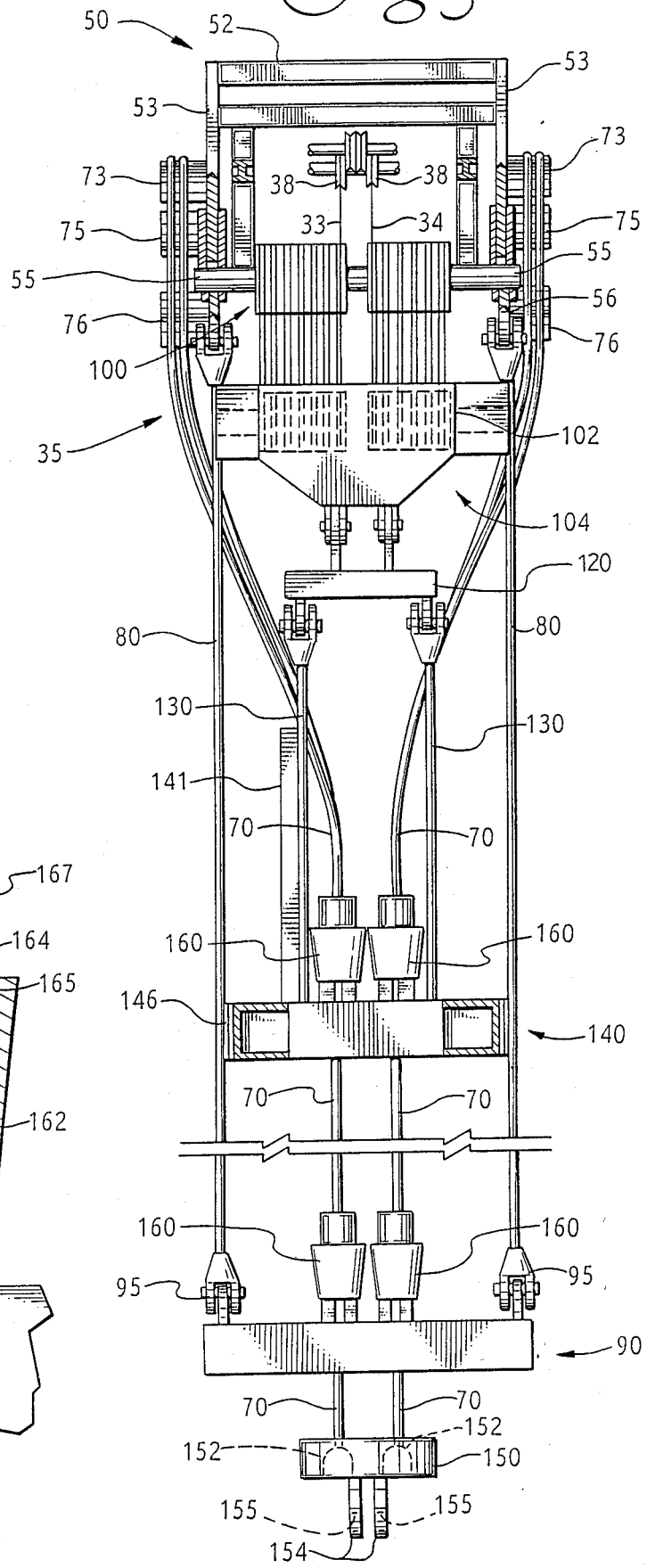
FIG. 3 is a front elevational view of the view of FIG. 2, with the pendants for the fixed lower platform foreshortened.

A basic principle of the invention is to take advantage of the existing drawworks and the main lines 33, 34 that are attached to hoist drums 31, 32 on the first equipment deck 15. These main lines 33, 34 lead to a main block assembly 35 that is best seen in FIGS. 2, 3. In general, the invention comprises a support means such as support truss 50 that straddles the boom 20 at the point of connection of the main tackle assembly 35. A stroker assembly 60 is suspended from the support truss 50 below the main tackle assembly 35. The stroker assembly 60 includes movable upper and fixed lower platform and gripper assemblies 140, 90, respectively, that, together with the main tackle assembly 35 form the major working parts of the present invention.

Referring also to FIGS. 2, 3, in general, the invention operates by using the lifting force of the main hoist drums 31, 32 (powered by existing power units (not shown)) to raise and lower the lower, main block 104 and the movable platform and gripper assembly 140 (comprising a movable gripper means) of the stroker assembly 60 to either take up or pay out one or more extended load lines 70. Between raising or lowering strokes of the movable platform and gripper assembly 140, the load lines 70 are held at the fixed platform and gripper assembly 90 (comprising a fixed gripper means). In the preferred embodiment there are four load lines 70, each comprising a six-inch wire rope or cable. They are used in a symmetrical (preferably rectangular) configuration in the stroker assembly 60 to help counterbalance the twisting tendencies present in such cables. It is well known that block twisting difficulties can lead to disasterous results, including lost loads. Accordingly, the right lay/left lay characteristics of the cables 70 are balanced when configured in a symmetrical fashion.

Each load line 70 is preferably two thousand or more feet long and provides the extended deepwater reach that is unavailable with the limited cable lengths that can be handled by the main hoist drums 31, 32. To take up and store the extended lengths of load lines 70, a take up reel 74 for each load line 70 is located on the first equipment deck 15 behind the main hoist drums 31, 32. If necessary, this deck 15 can be extended with side platforms to accomodate the reels 74. The load lines 70 are held alternately by linear winch grips 160 on the movable platform and gripper assembly 140 and the fixed platform gripper assembly 90, when the stroker assembly 60 is executing an upward or a downward stroke to either draw in or pay out the load line 70. The details of the support truss 50 and the stroker assembly 60 with its connection to the main tackle assembly 35 will be explained next.

Turning now to FIGS. 2, 3, the structure of the support truss 50 and the stroker assembly 60 can be seen. Support truss 50 is shaped roughly like an inverted U, comprising a cross-piece 52 and two parallel, downwardly extending arms 53. The crosspiece 52 extends across the top of boom 20, while the arms 53 extend downward on each side of the boom 20. To utilize the existing structural design of the crane 10, it is most favorable to have the support truss 50 attached at a pair of pins 55 mounted on the same axis as the multiple sheaves of the upper main tackle 100 of the main tackle assembly 35. This permits the stroker assembly 60 to be vertically aligned with the existing main tackle assembly 35. Also attached to the pins 55 are the triangular pendant equalizer supports 56, one on each pin 55.

Extending downward from each pendant equalizer support 56 are two pendants 80 (preferably also six-inch wire rope or cable) for the fixed platform and gripper assembly 90. Two pendants 80 of fixed, equal length extend downward on each side of the boom 20 in a configuration that appears in cross-section as the four corners of a rectangle. The lower platform pendants 80 terminate in clevis connections 95 at the fixed platform and gripper assembly 90. The two main lines 33, 34 of the existing drawworks of crane 10 pass over sheaves 38 to reach the main tackle assembly 35. The main tackle assembly 35 comprises an upper main tackle 100 that rotates on an axis aligned with the pins 55 and utilizes multiple parts of main lines 33, 34 to gain mechanical advantage. These parts extend between the upper main tackle 100 and the lower main tackle 102. Surrounding the lower main tackle 102 is a lower main block assembly 104 that, in turn, is attached to an upper frame connection block 120. Extending downward from the upper frame connection block 120 are four moveable platform pendants 130 of fixed, equal length (preferably also six-inch wire rope or cable) in a generally rectangular configuration similar to the fixed platform pendants 80 but smaller. The moveable platform pendants 130 terminate in clevis connections 145 at the moveable platform and gripper assembly 140.

The load lines 70 that extend from the take up reels 74 follow the boom 20 in the direction of the support truss 50. Immediately before reaching the support truss 50, the load lines 70 are guided downward over bending shoes 73, 75. Two of the load lines 70 are guided on each side of the boom 20, with each pair of lines 70 having its own pair of bending shoes 73, 75. Just below the pivot pins 55 is another pair of bending shoes 76 mounted on the pendant equalizer support 56. This pair of bending shoes 76, leads the load lines 70 downward toward the movable platform and gripper assembly 140. (All bending shoes 73, 75, 76 are shown as open guides for clarity; in actual construction, they would preferably be tubes that fully enclose and guide the load lines 70.) To guide the load lines 70 more towards the center of the moveable platform and gripper assembly 140, a further pair of bending shoes 141 extends upward from the moveable platform and gripper assembly 140. After being guided by the bending shoes 141 (only one of which is shown on the left side of FIG. 3), each load line 70 then passes through one of a set of four grippers 160 that are mounted on the top of the moveable platform and gripper assembly 140. The structure and operation of the these grippers 160 will be explained in greater detail below. After passing out the bottom of the moveable platform and gripper assembly 140, the load lines 70 continue downward in the direction of the fixed platform and gripper assembly 90. Here each load line 70 passes through one of an additional set of four grippers 160 that are mounted on the fixed platform and gripper assembly 90. Passing out the bottom of the fixed platform and gripper assembly 90, the load lines 70 reach their termination in a lower yoke 150 having four spelter sockets 152 therein and a pair of connection flanges 154 pierced by holes 155. These latter form the conventional point of attachment for various loads. From the set of grippers 160 on the moveable platform and gripper assembly 140 downward, the four load lines 70 are maintained in a rectangular configuration to discourage twisting.

Figure 4:
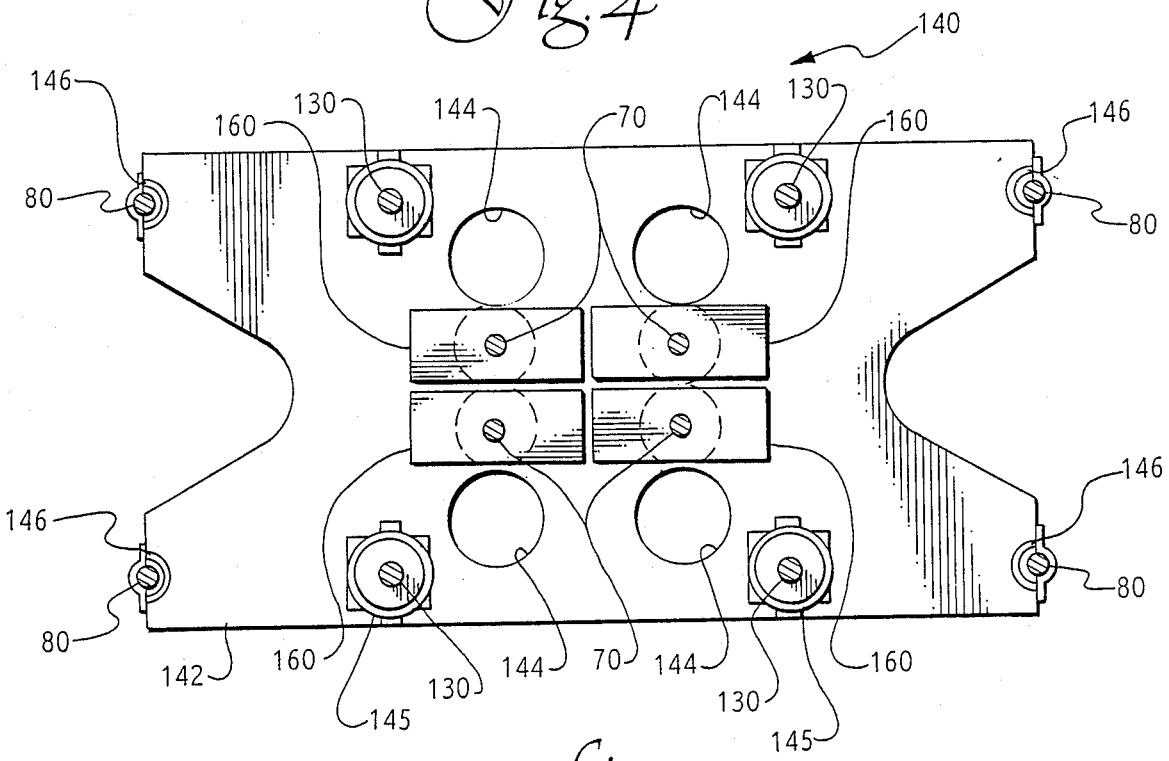
FIG. 4 is a sectional plan view of the movable upper platform assembly of the present invention taken along lines 4—4 of FIG. 2.

Turning now to FIG. 4, the detailed structure of the movable platform and gripper assembly 140 can be seen. The moveable platform and gripper assembly 140 consists of a generally rectangular moveable platform block 142 that has a set of four grippers 160 in a rectangular configuration in its center. Just outside of the four grippers 160 is a rectangular configuration of four holes 144 with adjacent slots that allow the load line spelters (not shown) to pass through the upper platform block 142 and be placed into the associated gripper 160 as the load lines 70 are threaded in the direction of the spelter sockets 152 in the lower yoke 150. Also in a rectangular configuration on the upper surface of the moveable platform and gripper block 140 are four pendant clevis connections 145. Each of these is connected to a moveable platform pendant 130. Near each of the corners of the moveable platform and gripper block 142 is a Teflon-lined pendant guide 146. Each of these guides 146 accomodates one of the four pendants 80 for the fixed platform and gripper assembly 90.

Figure 5:
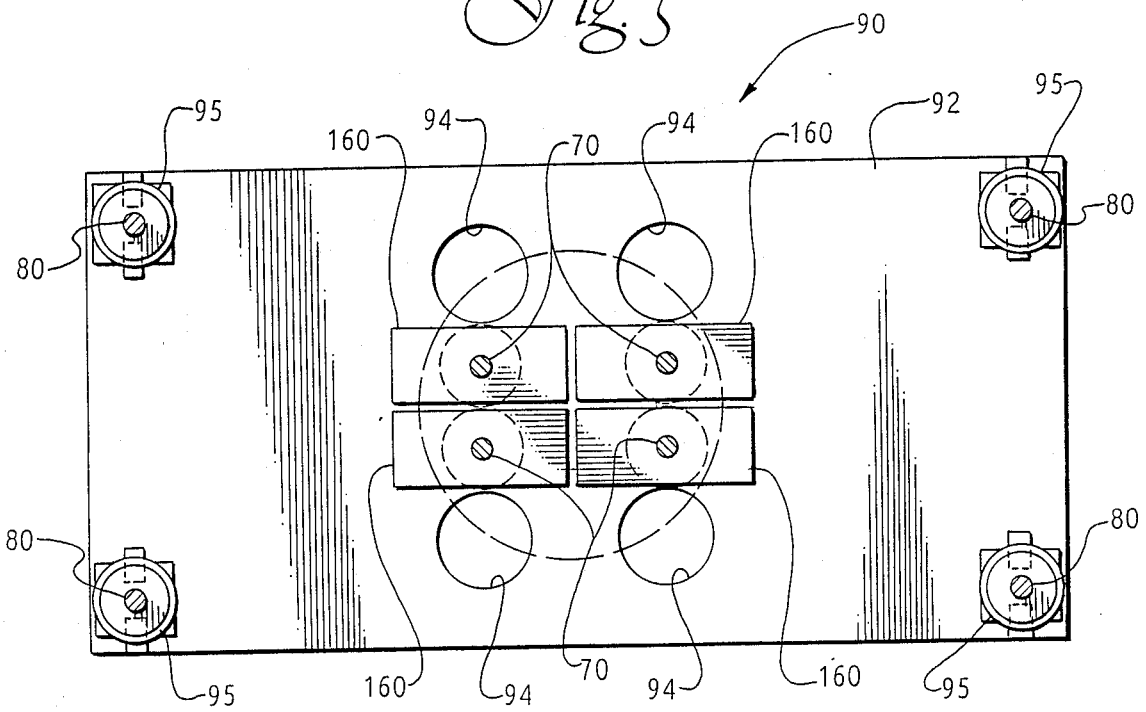
FIG. 5 is a sectional plan view of the fixed lower platform assembly of the present invention taken along line 5—5 of FIG. 2.

Turning now to FIG. 5, the detailed structure of the fixed platform and gripper assembly 90 is shown. The fixed platform and gripper assembly 90 comprises a fixed platform block 92 that is roughly rectangular in shape. In the center of the fixed platform block 92 in a rectangular configuration are four grippers 160 through which the load lines 70 pass. Surrounding the grippers 160 in a rectangular configuration are four holes 94 with associated slots through which the spelters of the load lines 70 pass when the load lines 70 are being threaded downward through the grippers 160 of the fixed platform and gripper assembly 90 to connect to the lower yoke 150. At each of the corners of the fixed platform block 92 is a pendant connection clevis 95. Each of the four pendant connection clevises 95 receives a pendant 80 for the fixed platform 92, extending downward from the pendant equalizer support 56.

It should be noted that while it is desirable to have four load lines 70 and to keep them in a relatively well-spaced rectangular configuration to avoid twisting, it is equally desirable to have a small cross-sectional profile for the load lines 70 and the lower yoke 150. In many applications, the load lines 70 and lower yoke 150 will be threaded through pipe or jackets that are 60, 72 or 84 inches in diameter. Accordingly, a relatively closely-spaced configuration of grippers 160 is chosen for the movable platform block 142 and the fixed platform block 92. This also helps to leave room for power or control leads that may need to follow the lower yoke 150.

Figure 6:
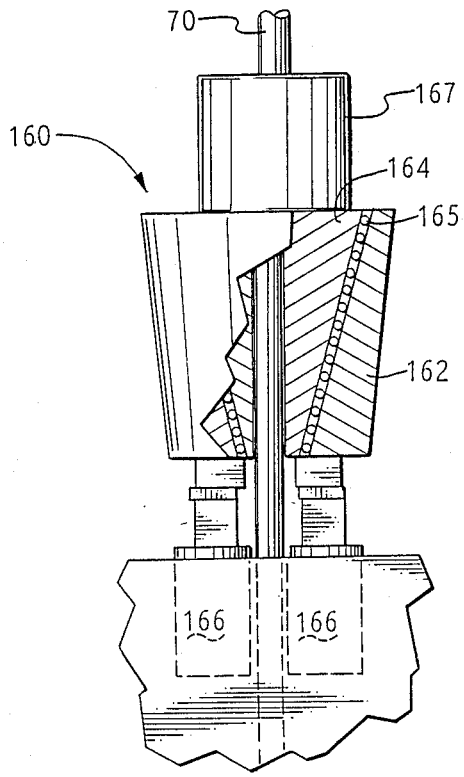
FIG. 6 is an enlarged detail of a gripper mechanism as used with the present invention, with parts cut away.

A gripper 160 as used on the moveable and fixed platform and gripper assemblies, 140, 90, respectively is shown in FIG. 6. Such grippers are conventional, one type being called a Lucker grip and being sold by AmClyde Engineered Products (division of Amca International Corporation) of St. Paul, Minn.. They are widely used in linear winches and often called linear winch grips. As can be seen, such a gripper 160 has a frame 162 in which a pair of grip wedges 164 is mounted for limited reciprocal movement on bearings 165. When the grip wedges 164 are moved toward the lower end of the gripper frame 162, the grip wedges 164 converge towards each other and grip the load line 70 that passes between them. When the grip wedges 164 are moved in the opposite direction, the load line 70 is released. Wedge movement is accomplished by hydraulic cylinders (not shown) that are part of each gripper control unit 167 and permit selective actuation and release of the gripper 160. It should be noted, however, that the cylinders that move the grip wedges 164 are not strong enough to withdraw the grip wedges 164 and release a load line 70 when it is loaded. The tension in the load line 70 when loaded draws the grip wedges 164 tighter, increasing the security of the hold of the gripper, but making release impossible, without relieving the tension in the load line 70.

Figure 7:
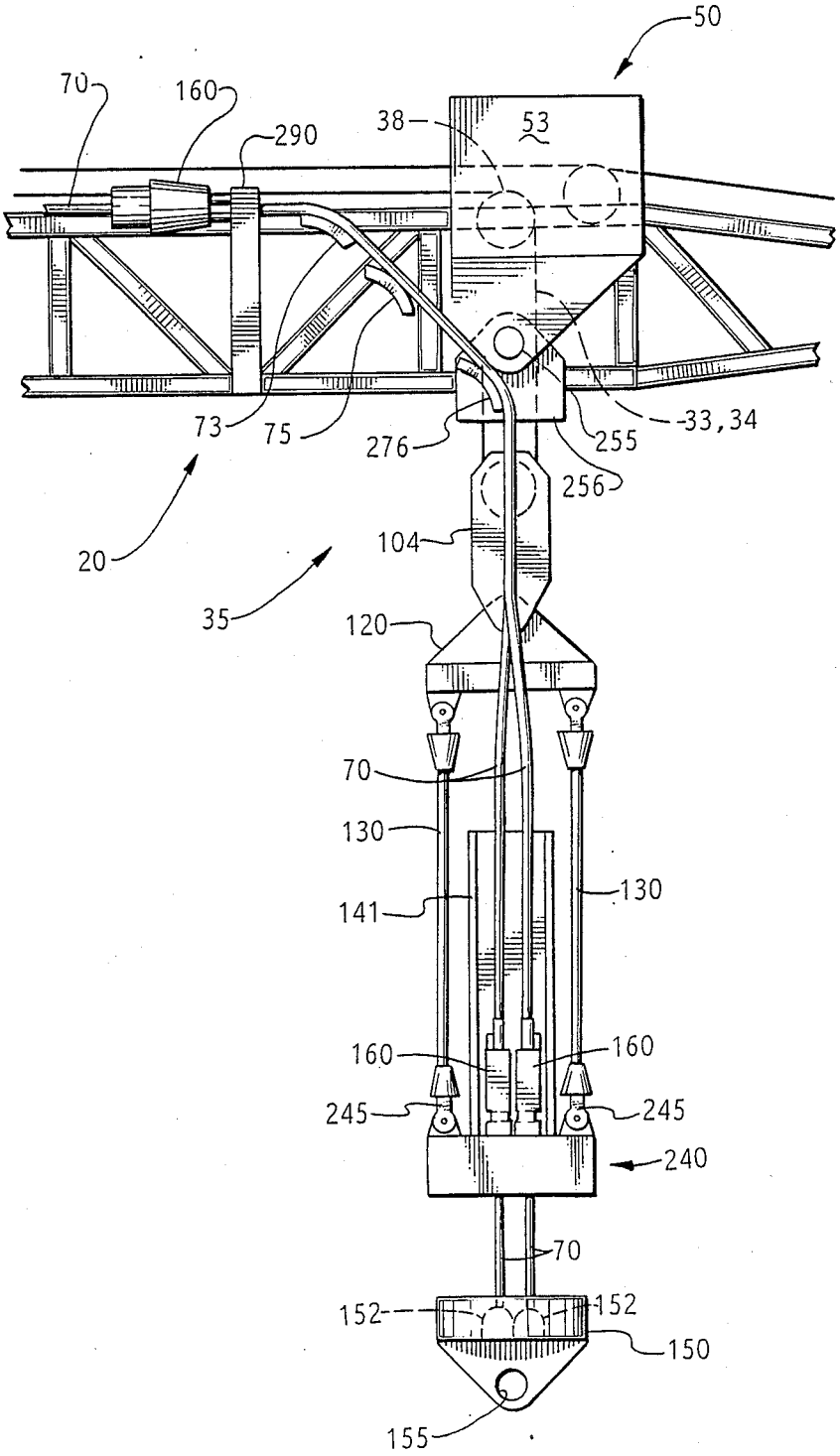
FIG. 7 is an enlarged detail as in FIG. 2 of an alternate embodiment of the invention.

An alternate embodiment of the invention is shown in FIG. 7. It starts with the principle that the present invention works by having one set of load line grippers that has a fixed location and another set of load line grippers that moves in repeated strokes between the grippers having a fixed location and some other point defining the end of a stroke. The grippers having a fixed location may be located above or "upstream" from the movable or stroking grippers (that is, closer to take up reels 74) or they may be located below or "downstream (that is, closer to lower yoke 150), as shown in FIGS. 1–6. In the embodiment shown in FIG. 7, the fixed platform and gripper assembly 90 of FIGS. 1–6, which provides a fixed location for a set of four grippers 160 that hold the load lines 70 when the grippers 160 on the moveable platform and gripper assembly 140 are not holding the load lines 70, is removed. Instead, a fixed location for the grippers 160 previously located on the fixed platform and gripper assembly 90 is provided above the main tackle assembly 35, specifically on the boom 20 just "upstream" from the truss 50. In particular, a pair of grippers 160 (only one gripper is visible in FIG. 7) is located on each side of the boom 20 on a reinforced cross piece 290. That is, the pair of load lines 70 that follows each side of the boom 20 and curves downward at the bending shoes 73, 75 now passes through a pair of fixed grippers 160 before reaching the bending shoes 73, 75 (which would need to be reinforced, due to their greater exposure to load in this embodiment). The support truss 50 remains in place, but the pendant equalizer support 56 is replaced by a smaller bending shoe support 256 attached to the support truss 50 at pins 255. A bending shoe 276 is located on the side of the bending shoe support 256 to aid the two load lines 70 on each side of the boom 20 in turning downward toward the lower yoke 150.

The lower main block assembly 104 remains in place, with the upper frame connection block 120 connected to it. The four pendants 130 that are connected to the upper frame connection block 120 also remain in place, but they are attached at four clevis connections 245 to a movable platform and gripper assembly 240 that does not need to guide the four pendants 80 that in the previously-described embodiment extend downward to the fixed lower platform and gripper assembly 90 (FIGS. 1–6). The alternate embodiment's movable upper platform and gripper assembly 240 still has on it the four grippers 160 in the same configuration as in the embodiment previously described. The load lines 70 pass through these four grippers 160 and are connected to the lower yoke 150 at spelter sockets 152 just as in the previously described embodiment.

As can be seen, in this embodiment, the moveable platform and gripper assembly 240 (comprising movable gripper means) reciprocates between an upper point defined by the approach of the lower main block assembly 104 to the boom 20 and a lower point that can be selected by the crane operator. Usually, this lower point will be above the surface of any water in which the crane 10 is working, but it is limited only by the length of the main lines 33, 34 that are used to raise and lower the lower main block assembly 104 together with the moveable platform and gripper assembly 240. As can further be seen, the same mode of operation would occur if the grippers 160 on the boom 20 (comprising fixed gripper means) were mounted on an enlarged bending shoe support 256. This further alternative to the structure shown in FIG. 7 would require greater structural strength at the support 256, but would avoid the need to increase load carrying capacity at the bending shoes 73, 75, 276.

OPERATION

In operation, the present invention as shown in FIGS. 1–6 functions as follows. To lower the lower yoke 150 and pay out the load line 70, the grippers 160 of the fixed platform and gripper assembly 90 (which remains throughout all operations at a fixed distance from the boom 20) are actuated so they take the load, transmitting it via the fixed platform block 92 and the pendants 80 to the support truss 50 and boom 20. The grippers 160 of the moveable platform and gripper assembly 140 are released, and this assembly 140 is then raised as high as it can travel in the direction of the upper main tackle 100. This is done by drawing in on the main lines 33, 34, utilizing the main hoist drums 31, 32. Accordingly, this is the same as any other lifting operation performed by the crane 10 before modification with the present invention. When the upper platform and gripper assembly 140 is near its maximum height relative to the upper main tackle 100, the grippers 160 of the moveable platform and gripper assembly 140 are actuated to grasp all four of the load lines 70 while the grippers 160 of the fixed platform and gripper assembly 90 are released. This actuation, together with the tension in the load lines 70 caused by a load (not shown) at the lower yoke 150 (transferred to the moveable platform and gripper assembly 140 when the grippers 160 of the fixed platform and gripper assembly 90 release) locks each gripper 160 onto its respective load line 70. At this point, the main lines 33, 34 are paid out from the main hoist drums 31, 32 to lower the moveable platform and gripper assembly 140 towards the fixed platform and gripper assembly 90. Just before the limit of travel in this direction has been reached, the grippers 160 at the fixed platform and gripper assembly 90 are again actuated to grasp all four load lines 70, transferring the load to the boom 20 via pendants 80. The grippers 160 of the moveable platform and gripper assembly 140 can then be released. At this point, the upper platform and gripper assembly 140 can again be raised toward the upper main tackle 100. Upon approaching the end of available travel in this direction, the grippers 160 of the moveable platform and gripper assembly 140 can again be actuated to grasp the four load lines 70 and the grippers 160 of the fixed platform and gripper assembly 90 can be released. This permits an additional length of each load line 70, corresponding to the length of travel between the main tackle assembly 35 and the fixed location of the fixed platform and gripper assembly 90, to be paid out in the next downward cycle. For example, in a crane with a capacity of about 2000 short tons and a boom of about 235 feet operating at about a 100 foot radius, a stroke length of about 50 feet is attained. This permits 1000 feet of cable to be paid out in 20 strokes.

To draw in the load lines 70, the process is reversed. That is, to prepare for drawing up the load lines 70, the load is transferred to the fixed platform and gripper assembly 90, if it is not already being supported there, by actuating the grippers 160 there to hold the four load lines 70. The moveable platform and gripper assembly 140 is lowered to approach the fixed platform and gripper assembly 90. At the lowest point to which the moveable platform and gripper assembly 140 can travel, the load is transferred from the fixed platform and gripper assembly 90 to the moveable platform and gripper assembly 140 by actuating the grippers 160 of the moveable platform and gripper assembly 140, raising the load slightly and then releasing the grippers 160 of the fixed platform and gripper assembly 90. Now by drawing in the main lines 33, 34 by use of the power of main hoist drums 31, 32, the moveable platform and gripper assembly 140 can be raised toward the main tackle assembly 35. When the maximum travel of the moveable platform and gripper assembly 140 has been reached in this direction, the grippers 160 of the fixed platform and gripper assembly 90 can be actuated and the load lowered slightly to transfer the load to the fixed platform and gripper assembly 90 again. Thereafter, the grippers 160 of the moveable platform and gripper assembly 140 can be released and the moveable platform and gripper assembly 140 can be lowered towards the fixed platform and gripper assembly 90 for another lifting cycle.

As can be seen, by selective engagement and disengagement of the grippers 160 on the moveable, upper platform and gripper assembly 140 (movable gripper means) and the fixed, lower platform and gripper assembly 90 (fixed gripper means), successive lifting strokes or lowering strokes can be executed. Each of these strokes is powered by use of the main lines 33, 34 and the main hoist drums 31, 32 to raise or lower the lower main block assembly 104. This, in turn, raises or lowers the moveable platform and gripper assembly 140 relative to the boom 20 and the fixed platform and gripper assembly 80 suspended below the boom. The load is transferred back and forth between the support truss 50 on boom 20 and the main tackle assembly 35. Through repeated stroking of the stroker assembly 60 and use of the take up reels 74 to gather in or release extended cable lengths, load lines 70 of any desired available length can be paid out or drawn in. Accordingly, the length of the load lines 70 that the crane 10, as modified by the present invention, can handle is limited only by the size of the take up reels 74 and the available wire rope lengths having the desired load capacity.

The operation of the alternative embodiment as shown in FIG. 7 is similar to that of the embodiment shown in FIGS. 1–6, except that the grippers 160 that are connected to the boom 20 (fixed gripper means) above the moveable platform and gripper assembly 240 (movable gripper means) hold the load line 70 when the grippers 160 of the movable platform and gripper assembly 240 are not holding the load lines 70. That is, for example, when a load is being raised, the load is first held by the grippers 160 attached to the boom 20, while the moveable platform and gripper assembly 240 is lowered a distance sufficient to provide a reasonable stroke. Once the moveable platform and gripper assembly 240 has been lowered to this point, the grippers 160 on the moveable platform and gripper assembly 240 are engaged to hold the load lines 70 and the grippers 160 on the boom 20 can release the load lines 70. After the load has thus been transferred, the main lines 33, 34 are drawn in to raise the lower main block assembly 104 and the moveable platform and gripper assembly 240. The stroke is completed when the lower main block assembly 104 is in close proximity to the boom 20. At this point, the load is transferred from the grippers 160 on the moveable platform and gripper assembly 240 back to the fixed grippers 160 supported on the boom 20. The moveable platform and gripper assembly 240 can then be lowered for another stroke. If the load lines 70 are to be paid out, this process is reversed.

In the preferred embodiment the controls for the various grippers 160 on the moveable and fixed platform and gripper assemblies 140, 90 (or the grippers 160 on the boom 20 and the movable platform and gripper assembly 240 as shown in FIG. 7) are located in the control station 17 along with the other operator controls. While the grip controls are essentially on/off, to aid the operator, a programmable controller can be used to guide the operator through the sequence of steps for a lifting or lowering operation. Load cells (not shown) on each gripper 160 can be used to monitor the load in each cable 20. In addition, to aid in balancing the load among the cables, equalizing cylinders 166 can be used. These can provide slight raising or lowering of one gripper 160 relative to the others to help reduce its load and share that load more equally with the other grippers.

Although the description of a preferred and alternate embodiment has been presented, it is contemplated that various changes can be made without deviating from the spirit of the present invention. For example, while the preferred embodiment shows grippers 160 mounted on pendant-supported platforms, the fixed or non-reciprocating grippers 160 could also be mounted on the leg of an offshore jacket, on the end of a barge, on the boom point near the main upper tackle (as shown in FIG. 7) or even near the base of the boom 20. Also, while the present invention is best suited for adapting and improving an existing crane, it could also be included as part of the original design of a crane. Further, while 6-inch cable has been discussed for the load lines 70, smaller cables or, if available, larger cables could also be used by installing alternate grip wedges 164 adapted for cables of different sizes. Also, more or fewer than four load lines 70 could be used, and grippers other than the linear winch gripper 160 of FIG. 6 could be employed. In addition, while fixed platform and gripper assembly 90 in the preferred embodiment is described as fixed, this is in contrast to the moveable (or reciprocating) platform and gripper assembly 140. If desired, the length of the pendants 80 suspending the fixed platform and gripper assembly 90 could be adjustable to provide strokes of various lengths. Accordingly, it is intended that the scope of the present invention be dictated by the appended claims rather than by the description of the preferred embodiment.

What is claimed and desired to be protected by Letters Patent is:

1. An apparatus to increase available hook raising and lowering distance for attachment to a crane or other lifting structure having a boom and at least one lifting hook tackle utilizing at least one lifting line connected to a prime mover comprising:

support means attached to the boom substantially at the connection point of said at least one tackle for supporting a pendant platform;

a lower gripper platform suspended from said support means by pendant lines and being movable with said boom, said lower platform having at least one cable gripper mounted thereon;

an upper gripper platform operatively connected to the at least one lifting line associated with said at least one tackle above said lower gripper platform, said upper platform having at least one cable gripper mounted thereon and adapted to reciprocate between said lower gripper platform and said support means in response to the prime mover drawing in or paying out said at least one lifting line via said at least one tackle;

at least one extended load line passing through the at least one cable gripper on each of said lower and upper gripper platforms;

means for taking up and letting out the at least one extended load line; and control means connected to said at least one cable gripper mounted on each of said lower and upper gripper platforms for causing said cable grippers individually and selectively to release or to grip said at least one extended load line.

2. An apparatus to increase available hook raising and lowering distance for attachment to a crane or other lifting structure having a boom and at least one lifting hook tackle utilizing at least one lifting line connected to a prime mover comprising:

support means attached to the boom substantially at the connection point of said at least one tackle for supporting a pendant platform;

a lower gripper platform suspended from said support means, said lower platform having at least one cable gripper mounted thereon;

an upper gripper platform operatively connected to the at least one lifting line associated with said at least one tackle above said lower gripper platform, said upper platform having at least one cable gripper mounted thereon and adapted to reciprocate between said lower gripper platform and said support means in response to the prime mover drawing in or paying out said at least one lifting line via said at least one tackle;

at least one extended load line passing through the at least one cable gripper on each of said lower and upper gripper platforms;

means for taking up and letting out the at least one extended load line comprising at least one take-up reel; and control means connected to said at least one cable gripper mounted on each of said lower and upper gripper platforms for causing said cable grippers individually and selectively to release or to grip said at least one extended load line.

3. The apparatus as recited in claim 2 wherein the lower gripper platform is suspended from said support means by four pendant lines.

4. The apparatus as recited in claim 2 wherein the lifting tackle utilizes two lifting lines and each of said lifting lines is operatively connected to said upper gripper platform.

5. The apparatus as recited in claim 2 wherein each of the lower and upper gripper platforms has four linear winch grips thereon and said apparatus has four extended load lines, each of which passes through one of the four linear winch grips on each of the lower and upper gripper platforms.

6. The apparatus as recited in claim 2 further comprising a lower lifting yoke attached to said at least one extended load line.

7. The apparatus as recited in claim 2 wherein the at least one lifting hook tackle comprises the main tackle having the greatest lifting capacity of any tackle on the crane or other lifting structure.

8. An apparatus to increase available hook raising and lowering distance for attachment to a crane or other lifting structure having a boom extending from a base and at least one lifting hook tackle utilizing at least one lifting line connected to a prime mover comprising:

fixed, boom-mounted gripper means for gripping a load line, said fixed gripper means being supported by and movable with the boom and having at least one cable gripper thereon;

movable gripper means for gripping a load line, said movable gripper means being operatively connected to the at least one lifting line associated with said at least one tackle and having at least one cable gripper thereon, said movable gripper means further being adapted to reciprocate between said fixed gripper means and a point a preselected distance away from said fixed gripper means along said load line in response to the prime mover drawing in or paying out said at least one lifting line via said at least one tackle;

at least one extended load line passing through the at least one cable gripper on each of said fixed gripper means and said movable gripper means;

means for taking up and letting out the at least one extended load line; and control means connected to said at least one cable gripper on each of said fixed gripper means and said movable gripper means for causing said cable grippers individually and selectively to release or to grip said at least one extended load line.

9. An apparatus to increase available hook raising and lowering distance for attachment to a crane or other lifting structure having a boom extending from a base and at least one lifting hook tackle utilizing at least one lifting line connected to a prime mover comprising:

fixed gripper means for gripping a load line, said fixed gripper means being operatively connected to the boom and having at least one cable gripper thereon;

movable gripper means for gripping a load line, said movable gripper means being operatively connected to the at least one lifting line associated with said at least one tackle and having at least one cable gripper thereon, said movable gripper means further being adapted to reciprocate between said fixed gripper means and a point a preselected distance away from said fixed gripper means along said load line in response to the prime mover drawing in or paying out said at least one lifting line via said at least one tackle;

at least one extended load line passing through the at least one cable gripper on each of said fixed gripper means and said movable gripper means;

means for taking up and letting out the at least one extended load line comprising at least one take-up reel; and control means connected to said at least one cable gripper on each of said fixed gripper means and said movable gripper means for causing said cable grippers individually and selectively to release or to grip said at least one extended load line.

10. The apparatus as recited in claim 9 wherein the fixed gripper means is attached to the boom adjacent the connection point of said at least one tackle.

11. The apparatus is recited in claim 9 wherein the fixed gripper means is suspended from the boom below the connection point of said at least one tackle.

12. The apparatus as recited in claim 9 wherein the fixed gripper means is attached to the boom between the at least one tackle and the boom base.

13. The apparatus as recited in claim 9 wherein each of the fixed gripper means and the movable gripper means has four linear winch grips thereon and said apparatus has four extended load lines, each of which passes through one of the four linear winch grips on each of the fixed gripper means and the movable gripper means.

14. The apparatus as recited in claim 9 further comprising a lower lifting yoke attached to said at least one extended load line.

15. The apparatus as recited in claim 9 wherein the at least one lifting hook tackle comprises the main tackle having the greatest lifting capacity of any tackle on the crane or other lifting structure.

16. A crane or similar lifting apparatus comprising:

a boom extending from a base and having at least one lifting hook tackle thereon utilizing at least one lifting line connected to a prime mover;

fixed, boom-mounted gripper means for gripping a load line, said fixed gripper means being supported by and movable with the boom and having at least one cable gripper mounted thereon;

movable gripper means for gripping a load line, said movable gripper means being connected to the at least one lifting line associated with said at least one tackle and having at least one cable gripper mounted thereon, said movable gripper means further being adapted to reciprocate between said fixed gripper means and a point a preselected distance away from said fixed gripper means along said load line in response to the prime mover drawing in or paying out said at least one lifting line via said at least one tackle;

at least one extended load line passing through the at least one cable gripper on each of said fixed gripper means and said movable gripper means;

means for taking up and letting out the at least one extended load line; and control means connected to said at least one cable gripper on each of said fixed gripper means and said movable gripper means for causing said cable grippers individually and selectively to release or to grip said at least one extended load line.

17. A crane or similar lifting apparatus comprising:

a boom extending from a base and having at least one lifting hook tackle thereon utilizing at least one lifting line connected to a prime mover;

fixed gripper means for gripping a load line, said fixed gripper means being operatively connected to the boom and having at least one cable gripper mounted thereon;

movable gripper means for gripping a load line, said movable gripper means being connected to the at least one lifting line associated with said at least one tackle and having at least one cable gripper mounted thereon, said movable gripper means further being adapted to reciprocate between said fixed gripper means and a point a preselected distance away from said fixed gripper means along said load line in response to the prime move drawing in or paying out said at least one lifting line via said at least one tackle;

at least one extended load line passing through the at least one cable gripper on each of said fixed gripper means and said movable gripper means;

means for taking up and letting out the at least one extended load line comprising at least one take-up reel; and control means connected to said at least one cable gripper on each of said fixed gripper means and said movable gripper means for causing said cable grippers individually and selectively to release or to grip said at least one extended load line.

18. The apparatus as recited in claim 17 wherein the fixed gripper means is suspended from said boom below said movable gripper means by four pendant lines.

19. The apparatus as recited in claim 17 wherein each of the fixed gripper means and movable gripper means has four linear winch grips thereon and said apparatus has four extended load lines, each of which passes through one of the four linear winch grips on each of the fixed gripper means and movable gripper means.

20. The apparatus as recited in claim 17 wherein the fixed gripper means is attached to the boom between the at least one tackle and the base.

* * * * *